US005992982A

United States Patent [19]

Suzuki

[11] Patent Number: 5,992,982

[45] Date of Patent: Nov. 30, 1999

[54] INK JET HEAD AND METHOD FOR FABRICATING THE INK JET HEAD

[75] Inventor: Takumi Suzuki, Yokohama, Japan

[73] Assignee: Canon Kabushiki Kaisha, Tokyo, Japan

[21] Appl. No.: 08/968,725

[22] Filed: Nov. 12, 1997

[30] Foreign Application Priority Data

Nov. 12, 1996 [JP] Japan ..... 8-300258
Nov. 11, 1997 [JP] Japan ..... 9-308490

[51] Int. Cl.[6] ..... B41J 2/05
[52] U.S. Cl. ..... 347/63
[58] Field of Search ..... 347/54, 56, 63

[56] References Cited

U.S. PATENT DOCUMENTS 4,926,197 5/1990 Childers et al. .
5,008,689 4/1991 Pan et al. .
5,194,877 3/1993 Lam et al. .
5,774,150 6/1998 Kobayashi et al. ..... 347/63
5,861,902 1/1999 Beerling ..... 347/63
5,870,120 2/1999 Terai ..... 347/56

FOREIGN PATENT DOCUMENTS 09-1806 1/1997 Japan .

*Primary Examiner*—Sandra Brase
*Attorney, Agent, or Firm*—Fitzpatrick, Cella, Harper & Scinto

[57] ABSTRACT

An ink jet head comprises a discharge opening for discharging ink, an electro-thermal transducer for generating thermal energy used for discharge of the ink, and a substrate for supporting the electro-thermal transducer through a heat-accumulating layer, the electro-thermal transducer being applied a voltage to supply the thermal energy to the ink so as to generate a bubble in the ink, thereby discharging the ink by pressure upon generation of bubble, wherein the substrate is a substrate obtained by bonding a metal plate being machinable and having higher corrosion resistance than Al, onto a main metal substrate a main component of which is Al, by clad bonding.

11 Claims, 1 Drawing Sheet

FIGURE
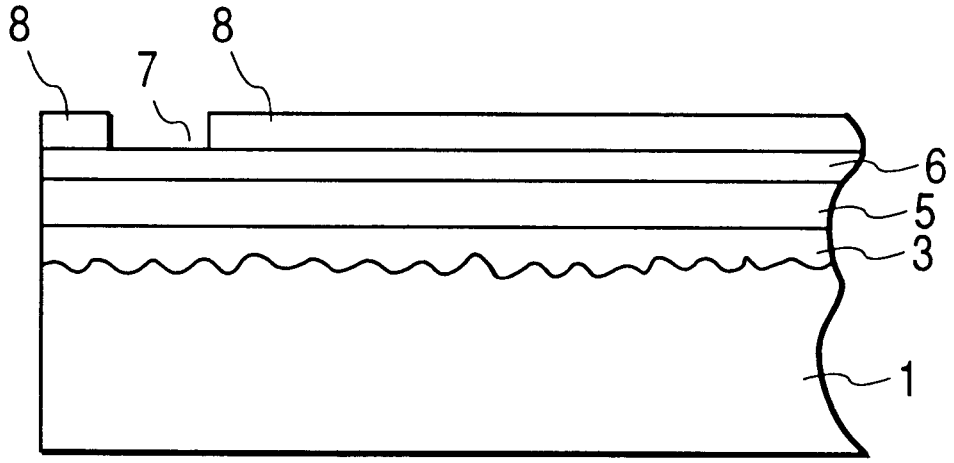

INK JET HEAD AND METHOD FOR FABRICATING THE INK JET HEAD

BACKGROUND OF THE INVENTION

1. Field of the Invention

The present invention relates to the structure of ink jet head and, more particularly, to the structure of ink jet head of a type using an electro-thermal transducer. The present invention provides a cheap and highly reliable head.

2. Related Background Art

In recent years use of metal substrate is under research as a substrate for ink jet heads of the type to eject ink by use of the electro-thermal transducer. This is from the following reason. The silicon substrate has been used heretofore as the substrate for the ink jet heads of this type. However, when the print width of ink jet head is intended to be set wide, the silicon substrate has a limit of increase in the size of substrate, because it is normally provided in the form of wafer. Therefore, desires exist for a substrate material excellent in workability. The ceramic substrate, which has been used in the conventional thermal heads and the like, is also one of substrate materials excellent in workability, but it is normally made in the structure provided with a glass-coat-baked layer (glaze layer) on a partial or entire surface because of its poor smoothness of substrate surface. In the case of the ink jet head of the type using the electro-thermal transducer, however, the head experiences such driving that the heater portion of electro-thermal transducer reaches temperatures near 1000° C. within a very short period, and it is thus difficult to apply the ceramic substrate to the ink jet head of the type using the electro-thermal transducer in terms of durability and heat-radiating characteristics of the glaze layer.

On the other hand, when the metal substrate is used as a substrate of ink jet head, surface roughness on the substrate also affects the durability of heat-generating resistor provided on the substrate, and thus metals the surface roughness of which can be readily decreased are used. Metals excellent in machinability, including Ni, SUS, and Al, have been used as such metals.

However, when Ni or SUS is used, the substrate thereof exhibits poor thermal characteristics (heat conductivity) and radiation of heat is not sufficient in applications of wide print width of ink jet head as described above. Therefore, such substrates are not suitable for high-speed printing.

Therefore, Al has been used heretofore as a material of the metal substrate. For example, Japanese Patent Application Laid-open No. 9-1806 discloses such structure that a heat-accumulating layer is provided through Cr on the metal substrate of Al in order to enhance adhesion between the metal substrate and the heat-accumulating layer. However, Al is poor in chemical stability and might be corroded by chemicals used during fabrication of head or components in the ink. The structure described in the above application resists corrosion from the surface of substrate, but in the structure Al is not protected by Cr at the end face of substrate where discharge openings are provided, and Al will be thus corroded by the ink intruding from the portion of discharge opening to the end face of substrate, which Could result in partial peeling of the Cr layer and the heat-accumulating layer. If the corrosion causes an impurity to be mixed in the ink, this impurity will form burnt deposits (scorches) on the heat-generating portion.

SUMMARY OF THE INVENTION

In view of the above problems, an object of the present invention is to provide a cheap ink jet head with sufficient thermal characteristics and with high reliability, but without degrading the durability of the heat-generating resistor (heater) provided on the metal substrate.

The above object is achieved by the following means.

The above object of the present invention is achieved by an ink jet head comprising a discharge opening for discharging ink, an electro-thermal transducer for generating thermal energy used for discharge of the ink, and a substrate for supporting the electro-thermal transducer through a heat-accumulating layer, the electro-thermal transducer being applied a voltage to supply the thermal energy to the ink so as to generate a bubble in the ink, thereby discharging the ink by pressure upon generation of bubble, wherein the substrate is a substrate obtained by bonding a metal plate being machinable and having higher corrosion resistance than Al, onto a main metal substrate a main component of which is Al, by clad bonding.

The above object of the present invention is also achieved by a method for fabricating an ink jet head, the ink jet head comprising a discharge opening for discharging ink, an electro-thermal transducer for generating thermal energy used for discharge of the ink, and a substrate for supporting the electro-thermal transducer through a heat-accumulating layer, the electro-thermal transducer being applied a voltage to supply the thermal energy to the ink so as to generate a bubble in the ink, thereby discharging the ink by pressure upon generation of bubble, the method comprising the steps of: preparing a main metal substrate a main component of which is Al; bonding a metal plate being machinable and having higher corrosion resistance than Al, onto the main metal substrate by clad bonding; providing the electro-thermal transducer through the heat-accumulating layer on the substrate having the metal plate bonded by clad bonding; and machining the substrate having the electro-thermal transducer to form a discharge-opening-formed surface in which a discharge opening is to be formed.

According to the present invention, Al as a main substrate is covered by the metal plate sufficiently thick, machinable, and higher in corrosion resistance than Al, and corrosion is thus prevented on the surface of substrate. Since the metal plate has the sufficient thickness, the exposed portion of the main substrate is located sufficiently apart from the discharge openings. Thus, even if the ink should intrude to the end face of substrate, the exposed portion would be more unlikely to touch the ink than before. In addition, it is not easy for the ink with mixture of impurity to return into the discharge openings. Accordingly, the aboves tat ed problems at the end face of substrate can be solved.

BRIEF DESCRIPTION OF THE DRAWING

FIGURE is a cross-sectional view to show a substrate portion of the ink jet head according to the present invention.

DESCRIPTION OF THE PREFERRED EMBODIMENTS

The present invention will be described in further detail by reference to the drawing.

FIGURE is a cross-sectional view to show a substrate portion of the ink jet head of the present invention.

In the drawing, reference numeral 1 designates the main substrate, which is a metal substrate the principal component of which is Al excellent in workability. In the present invention, for suppressing the corrosion of substrate surface in use of Al as the main substrate 1, a metal plate 3 with high corrosion resistance is provided on Al by clad (for effecting metal-to-metal bonding by making clean surfaces of the two plates contact with each other).

Here, a material of the metal plate 3 with high corrosion resistance used in the clad is one selected from Ni, Mg, Fe, Cu, and Zn, or alloys the main component of which is one of the stated metals, or alloys of two or more of the stated metals. The heat-accumulating layer is to be provided on the metal plate bonded by clad, and some of the above metal materials will exhibit insufficient adhesion to the heat-accumulating layer. In such cases, adhesion can be enhanced by forming a layer of high-melting-point metal with higher adhesion, such as Ti or Cr, on the metal plate bonded by clad.

The heat-accumulating layer 5 of $SiO_2$ or polyimide is formed on the above substrate, and heat-generating resistor layer 6 as an electro-thermal transducer and wiring electrode 8 are provided on the heat-accumulating layer 5. An exposed portion of the heat-generating resistor layer is the heat-generating portion 7. A protective film for protecting the electro-thermal transducer from the ink may be provided on this electro-thermal transducer.

In the present invention, for enhancing the machinability of the metal substrate, a preferred example of the main metal substrate is an Al alloy plate in which 0.1 to 10% by weight of Mg, Si, Cu, or the like is mixed.

The sufficient thickness of the metal plate bonded by clad is between 0.1 mm and 0.3 mm. If the metal layer having the thickness in this range were made by a film-forming method such as sputtering as heretofore, a lot of time would be necessary and stress of the film itself would be so high as to cause phenomena of warpage and peeling of substrate. Thus it is not preferred. The clad bonding in the present invention is the method that permit the thick metal film to be placed on the main substrate easily and with little stress.

In the ink jet head of the present invention, it is further preferable that a coating for prevention of corrosion be further provided on the discharge opening (formed) surface.

EXAMPLE

An example of the present invention will be described.

First prepared was an Al alloy plate in which 4% of Mg was mixed in pure Al in order to enhance workability. The surface of the Al alloy plate was polished to be finished in Ra of about 0.1, thereby obtaining the substrate. An Ni plate of 0.1 mm was bonded to the thus finished substrate by clad bonding. Then the Al surface opposite to the Ni-bonded surface was ground by grinding with a diamond cutting tool and electrolytic grinding so as to improve the surface roughness thereof. Here, "clad" means adhesion by metal-to-metal bonding achieved by urging smooth surfaces of metals against each other under high pressure. In addition to Ni described above, metals that can be bonded by clad include Mg, Fe, Cu, Zn, and so on. Such metals as Ni, Mg, Fe, Cu, and Zn are more unlikely to be corroded by the ink and the chemicals in the process than Al, but adhesion thereof will be lowered if their surface forms an oxidized layer. In the present example, therefore, a metal with high adhesion such as Ti or Cr was formed on the metal surface of Ni, Mg, Fe, Cu, Zn, or the like clad-bonded, before $SiO_2$ or polyimide to become the heat-accumulating layer was formed on the substrate; whereby adhesion of the metal surface was improved. Since the metals such as Ti and Cr show high adhesion and the thickness thereof does not have to be so thick (5 to 10 nm), it can be formed by an ordinary film-forming method such as sputtering. $SiO_2$ as the heat-accumulating layer described previously was formed on the thus obtained substrate, TaAl of heat-generating resistor and Al of wiring electrode were then sputtered on the heat-accumulating layer, and each of them was patterned in a predetermined pattern by photolithography, thereby forming the heat-generating resistor and wiring electrode. Further, the wiring electrode and heating portion were anodized to enhance the durability against the ink, thereafter an organic resin layer was applied thereto to form a coating thereof for protecting the wiring, the resin was removed in connecting portions to the outside, then through holes were formed, copper was sputtered in the thickness of 1 $\mu$m as terminals, thereafter electroplating of Ni and Au was carried out, and then unnecessary copper was removed by etching. A negative pattern of a photoresist was formed for making the discharge openings of ink jet head, an epoxy resin for forming ink flow paths was poured thereonto, and the resin was hardened. At this time a top plate may be used for matching of level difference as employed heretofore. After that, the substrate was cut to form the surface of discharge opening part, the unnecessary resist was removed, and ink supply, ink filter, etc. were formed, thereby completing the head of the present example.

Discharge tests were conducted with the ink jet head of the present invention thus completed, and it was confirmed thereby that stable printing was able to be made without deviation of positions where ink was applied. In addition, the burnt deposits on the heat-generating portion were reduced drastically, when compared with those in the conventional heads.

According to the present invention, even a substrate material that can make a relatively cheap substrate and that has the surface roughness not meeting the requirements of ink jet head becomes applicable by bonding a machinable metal to the surface thereof so that the surface property is improved by the machinable material, whereby the invention enables to form a cheap substrate. Even if Al easy in securing the surface property but low in corrosion resistance is used as a substrate material, the material excellent in corrosion resistance can be put thereon by clad bonding, whereby the invention can provide the substrate with high reliability and provide the cheap ink jet head with high reliability.

What is claimed is:

1. An ink jet head comprising a discharge opening for discharging ink, an electro-thermal transducer for generating thermal energy used for discharge of the ink, and a substrate for supporting the electro-thermal transducer through a heat-accumulating layer, the electro-thermal transducer being applied a voltage to supply the thermal energy to the ink so as to generate a bubble in the ink, thereby discharging the ink by pressure upon generation of bubble, wherein the substrate is a substrate obtained by bonding a metal plate being machinable and having higher corrosion resistance than Al, onto a main metal substrate a main component of which is Al, by clad bonding.

2. The ink jet head according to claim 1, wherein a material of the metal plate provided on the main substrate is one selected from the group consisting of metals of Mg, Fe, Ni, Cu, and Zn, alloys a main component of which is one of the metals, and alloys of at least two of the metals.

3. The ink jet head according to claim 1, wherein a high-melting-point metal layer is provided between the heat-accumulating layer and the substrate.

4. The ink jet head according to claim 3, wherein the high-melting-point metal is Ti or Cr.

5. The ink jet head according to claim 1, wherein the main metal substrate is an Al alloy in which Mg is mixed in Al.

6. The ink jet head according to claim 1, wherein a thickness of the metal plate provided on the main substrate is between 0.1 mm and 0.3 mm.

7. A method for fabricating an ink jet head, the ink jet head comprising a discharge opening for discharging ink, an electro-thermal transducer for generating thermal energy used for discharge of the ink, and a substrate for supporting the electro-thermal transducer through a heat-accumulating layer, the electro-thermal transducer being applied a voltage to supply the thermal energy to the ink so as to generate a bubble in the ink, thereby discharging the ink by pressure upon generation of bubble, the method comprising the steps of:

preparing a main metal substrate a main component of which is Al;

bonding a metal plate being machinable and having higher corrosion resistance than Al, onto the main metal substrate by clad bonding;

providing the electro-thermal transducer through the heat-accumulating layer on the substrate having the metal plate bonded by clad bonding; and machining the substrate having the electro-thermal transducer to form a discharge-opening-formed surface in which a discharge opening is to be formed.

8. The fabrication method of ink jet head according to claim 7, wherein a material of the metal plate provided on the main substrate is one selected from the group consisting of metals of Mg, Fe, Ni, Cu, and Zn, alloys a main component of which is one of the metals, and alloys of at least two of the metals.

9. The fabrication method of ink jet head according to claim 7, wherein a high-melting-point metal layer is provided between the heat-accumulating layer and the substrate.

10. The fabrication method of ink jet head according to claim 9, wherein the high-melting-point metal is Ti or Cr.

11. The fabrication method of ink jet head according to claim 7, wherein the main metal substrate is an Al alloy in which Mg is mixed in Al.

* * * * *

UNITED STATES PATENT AND TRADEMARK OFFICE

CERTIFICATE OF CORRECTION

PATENT NO. : 5,992,982

DATED : November 30, 1999

INVENTOR(S) : TAKUMI SUZUKI

It is certified that error appears in the above-identified patent and that said Letters Patent is hereby corrected as shown below:

COLUMN 1:

Line 11, "of" should read --of a--.
Line 16, "of" should read --of an--.
Line 18, "of" should read --of a--.
Line 36, "of" should read --of the--.
Line 53, "of" should read --of the--.
Line 55, "of" should read --of the--.
Line 59, "of" should read --of the-- and "Could" should read --could--.

COLUMN 2:

Line 47, "aboves tat ed" should read --above-stated--.

COLUMN 3:

Line 30, "of" should read --of the--.
Line 32, "permit" should read --permits--.

UNITED STATES PATENT AND TRADEMARK OFFICE

CERTIFICATE OF CORRECTION

PATENT NO. : 5,992,982

DATED : November 30, 1999

INVENTOR(S) : TAKUMI SUZUKI

It is certified that error appears in the above-identified patent and that said Letters Patent is hereby corrected as shown below:

COLUMN 6:

Line 4, "of" should read --of an--.
Line 10, "of" should read --of an--.
Line 14, "of" should read --of an--.
Line 16, "of" should read --of an--.

Signed and Sealed this

Fourteenth Day of November, 2000

*Attest:*

Q. TODD DICKINSON

*Attesting Officer*

*Director of Patents and Trademarks*